US005844160A

United States Patent [19]

Cieszkiewicz

[11] Patent Number: 5,844,160

[45] Date of Patent: Dec. 1, 1998

[54] LAND MINE CLEARING TOOL

[75] Inventor: Anthony F. Cieszkiewicz, Metamora, Ill.

[73] Assignee: Caterpillar Inc., Peoria, Ill.

[21] Appl. No.: 862,502

[22] Filed: May 23, 1997

[51] Int. Cl.[6] ..... F41H 11/16

[52] U.S. Cl. ..... 89/1.13

[58] Field of Search ..... 171/105; 89/1.13; 102/402

[56] References Cited

U.S. PATENT DOCUMENTS

| | | | |
|---|---|---|---|
| 891,954 | 6/1908 | Ross et al. . | |
| 1,807,150 | 5/1931 | Caldwell | 89/1.13 |
| 2,146,101 | 2/1939 | Weber | 89/1.13 |
| 2,242,808 | 5/1941 | Austin | 89/1.13 |
| 2,261,933 | 11/1941 | Flynn | 89/1.13 |
| 2,261,993 | 11/1941 | Flynn | 94/50 |
| 2,425,018 | 8/1947 | Williams | 89/1.13 |
| 2,442,390 | 6/1948 | Williams | 89/1.13 |
| 2,455,636 | 12/1948 | Woolson . | |
| 2,500,970 | 3/1950 | Walker | 180/9.1 |
| 2,509,163 | 5/1950 | Musselman | 89/1.13 |
| 3,771,413 | 11/1973 | Sieg et al. | 89/1 M |
| 4,765,221 | 8/1988 | Sombrowski | 89/1.13 |
| 4,909,128 | 3/1990 | Grinwald | 89/1.13 |
| 5,313,868 | 5/1994 | Wolf | 89/1.13 |
| 5,322,351 | 6/1994 | Lent | 299/87 |
| 5,404,661 | 4/1995 | Sahm et al. | 37/348 |
| 5,431,082 | 7/1995 | Zelverte et al. | 89/1.13 |
| 5,438,771 | 8/1995 | Sahm et al. | 37/348 |
| 5,442,990 | 8/1995 | Krohn | 89/1.13 |
| 5,471,391 | 11/1995 | Gudat et al. | 364/424.07 |
| 5,493,494 | 2/1996 | Henderson | 364/424.07 |
| 5,526,002 | 6/1996 | Gudat et al. | 342/457 |

FOREIGN PATENT DOCUMENTS

| | | | |
|---|---|---|---|
| 2430709 | 1/1976 | Germany | 89/1.13 |
| 497742 | 3/1956 | Italy | 89/1.13 |

OTHER PUBLICATIONS

BOA—Spitfire Demining System Pre–1996—Swedish Invention Brochure.

BOA—Spitfire Demining Systems For Military and Humanitarian Applications Brochure—Mid–1996.

BOA—The Spitfire Story—Mid–1996 Open letter from Lars Nylin—BOA Defence.

Bofors—Rapid and Safe Mine Clearance—Borfors Demining Vehicle—undated but conceded to be prior to Applicant's invention.

PCT Application—WO—96/15418—May 23, 1996 Aggregate for Obstacle Removal.

*Primary Examiner*—Charles Jordan
*Assistant Examiner*—Christopher K. Montgomery
*Attorney, Agent, or Firm*—O. Gordon Pence

[57] ABSTRACT

A forwardly-rotatable, driven-drum, land mine clearing tool has a plurality of robust, easily-repairable tool spokes extending radially from the outer surface of the drum. The land mine clearing tool is connected to the front end of a tracked vehicle and is operatively raised and lowered from the tracked vehicle. The drum and tool spokes engage the earth of a land mine field in a milling action, which grinds and destroys some land mines while triggering detonation of other land mines.

8 Claims, 2 Drawing Sheets

LAND MINE CLEARING TOOL

TECHNICAL FIELD

This invention relates to ordinance destruction and more particularly to an earthworking tool for milling and destroying land mines.

BACKGROUND ART

The International Red Cross estimates that there are over 110 million land mines scattered around the world which kill 10,000 people, mostly civilians, and injure another 20,000 every year. The situation worsens as new mines are deployed at a faster rate (1.5 to 2 million new mines per year) than they are being cleared.

Robust, efficient land mine clearing machines address the need for increased mine destruction rates. An effective method of mine removal and destruction is to clear a mine field with an earth milling device.

An earth milling device is typically attached to the front of an armored vehicle where it may be raised or lowered to desired earth milling depths. Upon encountering a live land mine, the milling device destroys a portion or all of it before detonation.

The earth milling device, or land mine clearing tool, typically has a plurality of radially disposed tool spokes (arms) attached to a rotating drum. These tool spokes may be of different lengths and typically have hardened tool heads (ends) which in turn may hold conventional asphalt planing bits.

One problem with the prior art mine clearing tools having radially disposed tool spokes is the cumbersome nature of changing the tool spokes. Spokes often need to be changed due to wear, damage or because a different digging depth is desired. A tool spoke having a base attached to a rotating drum has been known before, with a tool head fastened to the spoke base. The interface between the spoke base and the tool head is typically a male-female cylindrical socket arrangement. This socket arrangement often does not rigorously withstand blast loads nor bending loads commonly encountered when milling in mine fields. Consequently, when it is necessary to change a tool head, the tool head will often not disengage from the tool base due to a damaged socket interface.

A related problem occurs when it is desired to change the lengths of many or all tool spokes due to different terrain or mine depths. If during the spoke length change the tool heads fail to easily disengage from the tool bases, mine clearing operations are seriously slowed.

The present invention is directed to overcoming one or more of the problems set forth above.

DISCLOSURE OF THE INVENTION

In one aspect of the invention, a land mine clearing tool is provided. The tool has a rotatable drum which has an outer surface. Also, the land mine clearing tool has a plurality of tool spokes, each having a tool base, a tool holder and a tool head. The tool bases are attached to the drum outer surface and extend radially outwardly from the drum outer surface. Each tool holder, tool base and tool head are easily removable and robustly withstand mine blast and milling bending loads.

In another aspect of the present invention, a land mine clearing machine is provided. The machine includes a front-end portion, a tool carrier pivotally connected to the front-end portion, and a land mine clearing tool having a drum and being rotatably connected to the tool carrier. The drum has an outer surface. The land mine clearing tool has a plurality of tool spokes, each having a tool base, a tool holder and a tool head. The tool bases are attached to the drum outer surface and extend radially outwardly from the drum outer surface. Each tool holder, tool base and tool head are easily removable and robustly withstand mine blast and milling bending loads.

BEST MODE FOR CARRYING OUT THE INVENTION

Figure 1:
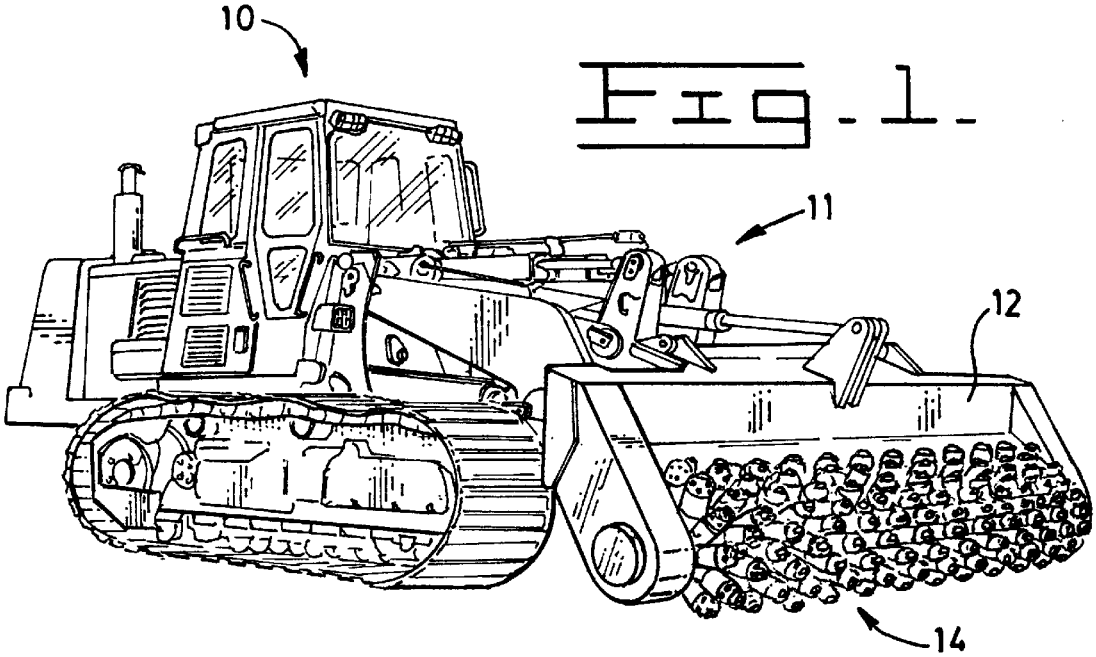
FIG. 1 is a schematic view of a mine clearing machine.

Land mine clearing machine 10 is shown schematically in FIG. 1 with front-end portion 11. Tool carrier 12 is pivotally connected to front-end portion 11 and land mine clearing tool 14 is rotatably connected to tool carrier 12. Tool carrier 12 has longitudinal axis 18 (FIG. 3).

Figure 2:
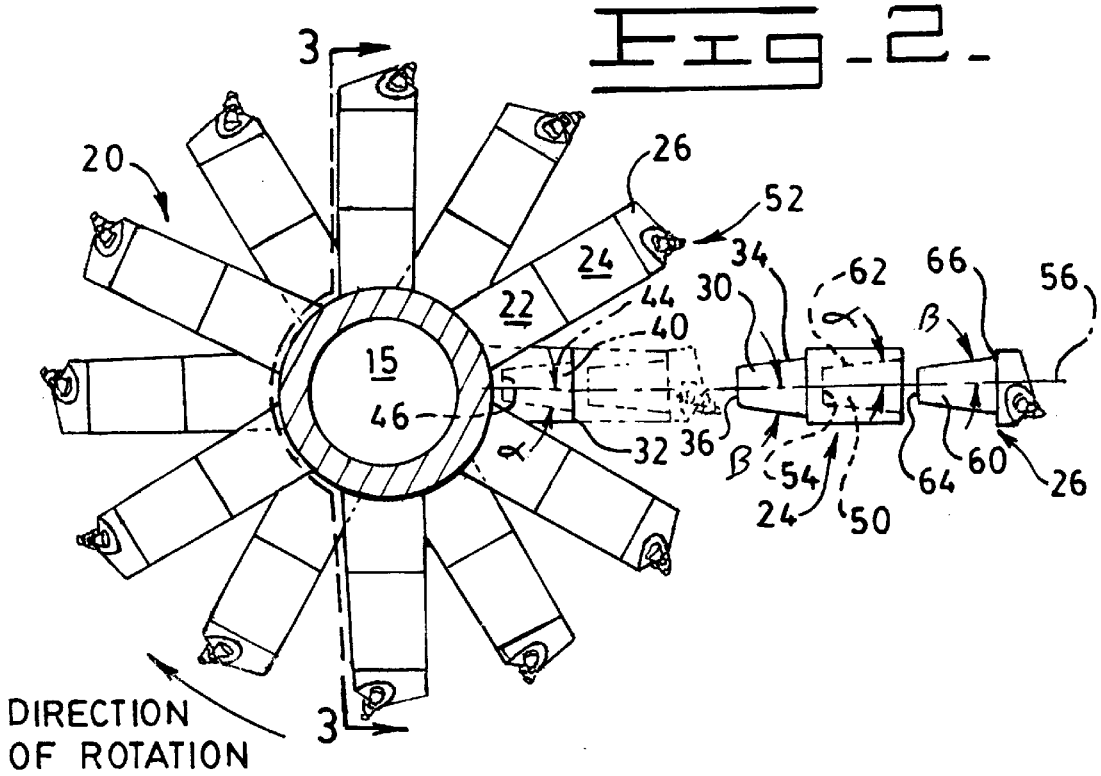
FIG. 2 is a diagrammatic side view of a land mine clearing tool.
Figure 3:
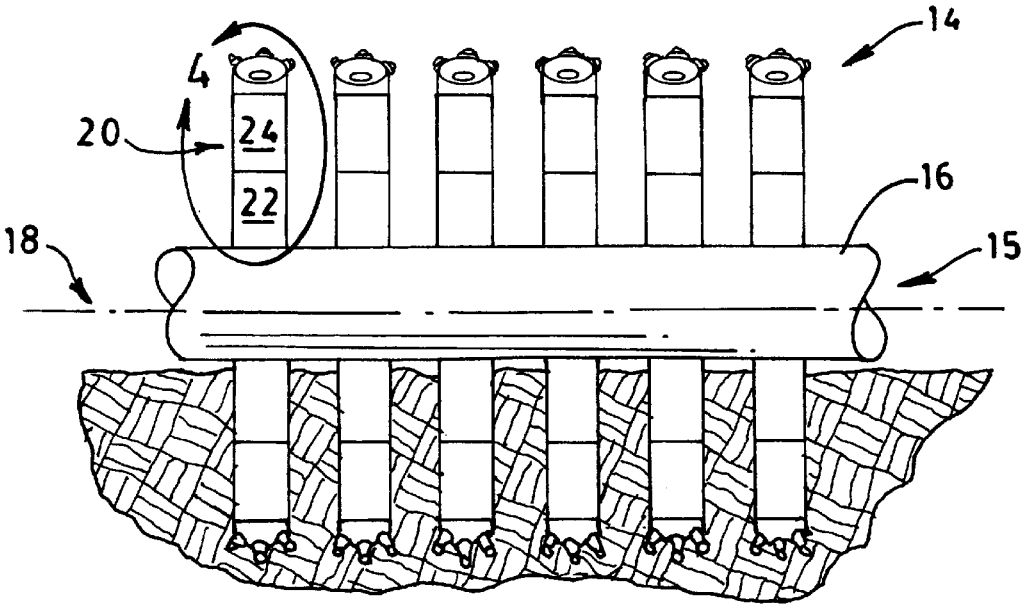
FIG. 3 is a diagrammatic front view of a land mine clearing tool taken along the line 3—3 of FIG. 2.
Figure 4:
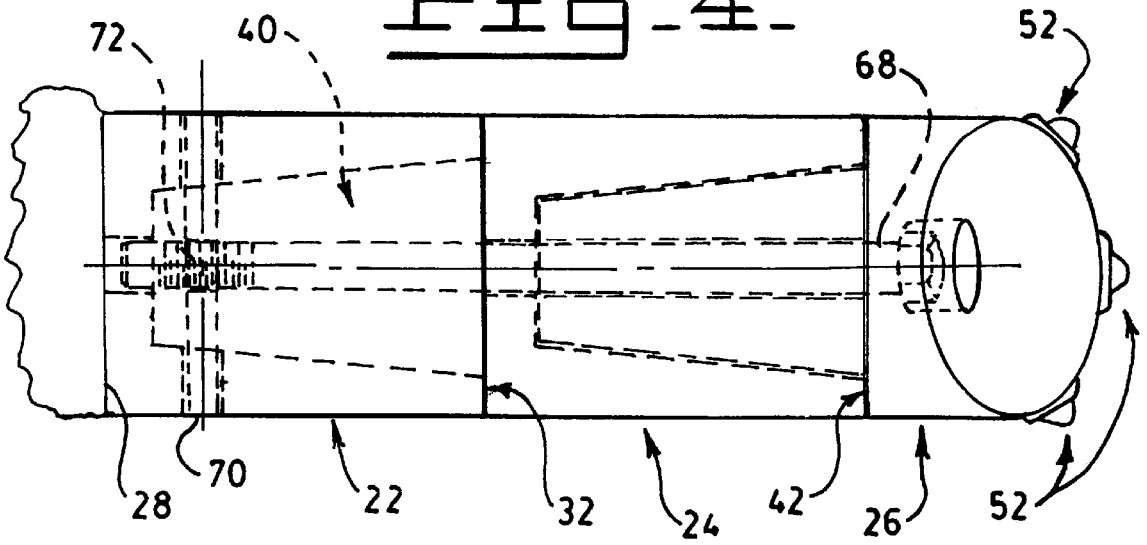
FIG. 4 is a diagrammatic top view of a tool spoke taken along the line 4—4 of FIG. 3.

As seen in FIGS. 2, 3 and 4, land mine clearing tool 14 has hollow drum 15 which in turn has outer surface 16. Attached to outer surface 16 is a plurality of cylindrical tool spokes 20, arranged in equally-spaced, equally-offset rows. Each tool spoke 20 has a tool base 22 attached at base proximal end 28 to drum outer surface 16, a tool holder 24 removably attached to tool base 22, and a tool head 26 removably attached to tool holder 24. Each tool head 26 has at least one bit 52 attached to tool head distal end 65. Each tool head 26 is secured to tool base 22 by bolt 68. Bolt 68 passes internally through tool head 26 to tool base 22 where the threaded end of bolt 68 engages threaded receiver 72 of pivoting pin 70.

The drum of the land mine clearing tool 14 rotates in a forward direction about longitudinal axis 18. This thereby rotates the attached tool spokes 20 and causes bits 52 to diggingly engage the mine field. The motive power for causing rotation is preferably hydraulic power (not shown) because such power systems typically withstand sudden shocks (mine explosions, large rocks, etc.) better than other power systems in this application.

As seen in FIG. 2, each tool spoke 20 is segmented into a tool base 22, a tool holder 24 and a tool head 26 as described above. To dig land mines in different terrain and depths, the lengths of tool holder 24 and tool head 26 may be varied.

Shown in FIGS. 2 and 4 is the preferred embodiment for joining tool holder 24 with tool base 22. As shown, first pocket portion 40 of tool base 22 matingly receives first projecting portion 30 of tool holder 24. While these parts share an interface at first joint 32, first pocket side 44, having a cylindrical, conical shape, matingly contacts the periphery of first projecting side 34, it also being cylindrical and conically-shaped. Holder proximal end 36 does not contact first pocket proximal end 46, as first pocket side 44 and first projecting side 34 form the principal load-bearing, interfacing surfaces. It is important to note that holder proximal end 36 does not contact first pocket proximal end 46. A principal reason for this is that the conically-shaped sides of first pocket side 44 and first projecting side 34 withstand axial and bending loads better than the flatter-shaped holder proximal end 36 and first pocket proximal end 46 because the former have more surface area to distribute loads than the latter.

The conically-shaped first pocket side 44 is shaped to a preselected angle (α) from tool spoke 20 longitudinal axis 56. Likewise, first projecting side 34 is shaped to a preselected angle (β) relative to longitudinal axis 56. Angle (α) and angle (β) have a magnitude of between three (3) and twelve (12) degrees in the preferred embodiment. This range of magnitudes is preferred because magnitudes less than three degrees increase the probability of undesirable contact between holder proximal end 36 and first pocket proximal end 46 while angles greater than twelve degrees result in less contact area to distribute shock and bending loads and require a heavier tool spoke 20 to achieve the desired performance.

The preferred embodiment for joining tool head 26 with tool holder 24 is shown in FIG. 2. Similar to the manner in which tool holder 24 joins tool base 22, second pocket portion 50 of tool holder 24 matingly receives second projecting portion 60 of tool head 26. While the parts share an interface at second joint 42, second pocket side 62, having a cylindrical, conical shape, matingly contacts the periphery of second projecting side 66, it also being cylindrical and conically-shaped. Holder pocket proximal end 54 does not contact tool head proximal end 64, as second pocket side 62 and second projecting side 66 form the principal load-bearing, interfacing surfaces. It is important to note that tool head proximal end 64 does not contact holder pocket proximal end 54. A principal reason for this is that the conically-shaped sides of second pocket side 62 and second projecting side 66 withstand axial and bending loads better than the flatter-shaped tool head proximal end 64 and holder pocket proximal end 54 because the former have more surface area to distribute shock loads than the latter.

The conically-shaped second pocket side 62 is shaped to a preselected angle (α) from tool spoke 20 longitudinal axis 56. Likewise, second projecting side 66 is shaped to a preselected angle (β) relative to longitudinal axis 56. Angle (α) and angle (β) have a magnitude of between three (3) and twelve (12) degrees in the preferred embodiment. This range of magnitudes is preferred because magnitudes less than three degrees increase the probability of undesirable contact between holder pocket proximal end 54 and tool head proximal end 64 while angles greater than twelve degrees result in less contact area to distribute shock and bending loads and require a heavier tool spoke 20 to achieve the desired performance.

Industrial Applicability

The operator of the land mine clearing machine 10 raises and lowers tool carrier 12 to cause land mine clearing tool 14 to operate at a desired operating depth. Controls within the land mine clearing machine (not shown) regulate machine direction, speed and tool rotational speed. Land mine clearing tool 14 rotates forward at a preselected rotational speed, causing tool head bit 52 to dig into the mine field. The rotation of mine clearing tool 14 mills the contents of the mine field, effectively grinding soil, entrained rocks, growth and land mines into relatively small particles. The intent of the milling is to destroy by grinding any mines before detonation. However, mines may detonate as they are struck by tool spokes 20 and thereby damage portions of land mine clearing tool 14.

If bit 52 becomes worn or damaged, the operator may stop demining operations and replace bit 52. Likewise, if a tool head 26 or tool holder 24 becomes worn or damaged, the operator may stop demining operations, unbolt tool spoke bolt 68, and replace the necessary spoke components. If a tool base 22 is damaged, a replacement tool base 22 is welded in place. It is advantageous to have an entire replacement mine clearing tool 14 on site to speed operations when multiple repairs may be required.

Other aspects and advantages of this invention can be obtained from a study of the drawings, the disclosure and the appended claims.

I claim:

1. A land mine clearing tool comprising:

a drum having an outer surface and being rotatable on a longitudinal axis, and a plurality of tool spokes each having a tool base, a tool holder and a tool head, said tool base being attached to said outer surface and extending radially outwardly from said outer surface, said tool holder being removably connected to said tool base, said tool head having a bit, and said tool head being removably connected to said tool holder, said tool base having a first pocket portion, and said tool holder having a first projecting portion, said first projecting portion being matingly engageable with said first pocket portion; said first pocket portion having a conically-shaped first pocket side and said first projecting portion having a conically-shaped first projecting side, said first pocket portion being matingly engageable with said first projecting portion.

2. The land mine clearing tool according to claim 1, wherein each of said tool spokes has a longitudinal spoke axis, and said first pocket side being at a preselected angle (α) relative to said spoke axis, and said first projecting side being at a preselected angle (β) relative to said spoke axis.

3. The land mine clearing tool according to claim 2 wherein said angle (α) and said angle (β) have a magnitude of between three and twelve degrees.

4. The land mine clearing tool according to claim 1 wherein said tool holder has a second pocket portion, and said tool head has a second projecting portion; said second projecting portion being matingly engageable with said second pocket portion; said second pocket portion having a conically-shaped second pocket side and said second projecting portion having a conically-shaped second projecting side, said second pocket portion being matingly engageable with said second projecting portion.

5. The land mine clearing tool according to claim 4, wherein each of said tool spoke has a longitudinal spoke axis, and said second pocket side being at a preselected angle (α) relative to said spoke axis, and said second projecting side being at a preselected angle (β) relative to said spoke axis.

6. The land mine clearing tool according to claim 5 wherein said angle (α) and said angle (β) have a magnitude of between three and twelve degrees.

7. A land mine clearing machine, comprising:

a front-end portion;

a tool carrier pivotally connected to said front-end portion;

a land mine clearing tool having a drum and being rotatably connected to said tool carrier, said drum having an outer surface; and a plurality of tool spokes each having a tool base, a tool holder and a tool head, said tool base being attached to said outer surface and extending radially outwardly from said outer surface, said tool holder being removably connected to said tool base, said tool head having a bit, said tool head being removably connected to said tool holder, and said tool holder and said tool head each having a selected one of a plurality of different lengths, said tool base having a pocket portion, and said tool holder having a first projecting portion, said first pocket portion having a conically-shaped first pocket side and said first projecting portion having a conically-shaped first projecting side, said first pocket portion being matingly engageable with said first projecting portion, each of said tool spokes having a longitudinal spoke axis, and said first pocket side being at a preselected angle ($\alpha$) relative to said spoke axis, said first projecting side being at a preselected angle ($\beta$) relative to said spoke axis, and said angle ($\alpha$) and said angle ($\beta$) having a magnitude of between three and twelve degrees.

8. The land mine clearing machine of claim 7 wherein said tool holder has a second pocket portion, and said tool head has a second projecting portion, said second pocket portion having a conically-shaped second pocket side and said second projecting portion having a conically-shaped second projecting side, and said second pocket portion being matingly engageable with said second projecting portion, each of said tool spokes having a longitudinal spoke axis, and said second pocket side being at a preselected angle ($\alpha$) relative to said spoke axis, said second projecting side being at a preselected angle ($\beta$) relative to said spoke axis, and said angle ($\alpha$) and said angle ($\beta$) having a magnitude of between three and twelve degrees.

* * * * *